US009027637B2

(12) United States Patent
Kang et al.

(10) Patent No.: US 9,027,637 B2
(45) Date of Patent: May 12, 2015

(54) FLOW CONTROL SCREEN ASSEMBLY HAVING AN ADJUSTABLE INFLOW CONTROL DEVICE

(71) Applicant: Halliburton Energy Services, Inc., Houston, TX (US)

(72) Inventors: James Jun Kang, Dallas, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/245,070

(22) Filed: Apr. 4, 2014

(65) Prior Publication Data

US 2014/0305630 A1 Oct. 16, 2014

(51) Int. Cl.
*E21B 43/08* (2006.01)
*E21B 34/06* (2006.01)

(52) U.S. Cl.
CPC ..... *E21B 34/063* (2013.01); *E21B 43/08* (2013.01)

(58) Field of Classification Search
CPC ..... E21B 34/063; E21B 43/08; E21B 43/12
USPC ..... 166/205, 376, 317, 227–236
See application file for complete search history.

(56) References Cited

U.S. PATENT DOCUMENTS 3,057,405 A * 10/1962 Mallinger ..... 166/288
3,273,641 A * 9/1966 Bourne ..... 166/276
4,157,732 A * 6/1979 Fonner ..... 166/376
4,202,411 A * 5/1980 Sharp et al. ..... 166/244.1
5,224,556 A * 7/1993 Wilson et al. ..... 175/4.53
5,228,518 A * 7/1993 Wilson et al. ..... 166/369
5,355,956 A * 10/1994 Restarick ..... 166/296
6,776,238 B2 * 8/2004 Dusterhoft et al. ..... 166/308.1
7,527,103 B2 * 5/2009 Huang et al. ..... 166/311
7,559,375 B2 7/2009 Dybevik et al.
7,699,101 B2 * 4/2010 Fripp et al. ..... 166/229
7,789,151 B2 * 9/2010 Langeslag ..... 166/296
7,789,152 B2 * 9/2010 Langeslag ..... 166/296
7,810,567 B2 10/2010 Daniels et al.
7,832,473 B2 * 11/2010 Pensgaard ..... 166/193
7,918,272 B2 4/2011 Gaudette et al.
8,211,247 B2 * 7/2012 Marya et al. ..... 148/400
8,297,364 B2 * 10/2012 Agrawal et al. ..... 166/376
8,327,931 B2 * 12/2012 Agrawal et al. ..... 166/193
8,424,610 B2 * 4/2013 Newton et al. ..... 166/376

(Continued)

OTHER PUBLICATIONS

Dictionary definitions of "caustic" and "stimulus", accessed Jun. 9, 2014 via thefreedictionary.com.*

(Continued)

*Primary Examiner* — Blake Michener
(74) *Attorney, Agent, or Firm* — Haynes and Boone, LLP

(57) ABSTRACT

A well system has a fluid flow path for the inflow of production fluid. An inflow control device is disposed within the fluid flow path. The inflow control device has at least first and second fluid passageways. A first plug is disposed within the first fluid passageway and is operable to restrict fluid flow therethrough. The first plug is operably removable from the first fluid passageway responsive to a first stimulus. A second plug is disposed within the second fluid passageway and is operable to restrict fluid flow therethrough. The second plug is operably removable from the second fluid passageway responsive to a second stimulus, wherein the first stimulus is different from the second stimulus.

24 Claims, 6 Drawing Sheets

(56) References Cited

U.S. PATENT DOCUMENTS

| | | | | |
|---|---|---|---|---|
| 8,430,173 | B2 * | 4/2013 | Todd et al. | 166/376 |
| 2003/0070811 | A1 * | 4/2003 | Robison et al. | 166/298 |
| 2003/0075324 | A1 * | 4/2003 | Dusterhoft et al. | 166/279 |
| 2003/0141061 | A1 * | 7/2003 | Hailey et al. | 166/278 |
| 2007/0039741 | A1 * | 2/2007 | Hailey | 166/376 |
| 2008/0135249 | A1 * | 6/2008 | Fripp et al. | 166/285 |
| 2008/0236843 | A1 | 10/2008 | Scott et al. | |
| 2009/0101342 | A1 * | 4/2009 | Gaudette et al. | 166/276 |
| 2009/0283271 | A1 * | 11/2009 | Langeslag | 166/297 |
| 2010/0051262 | A1 * | 3/2010 | Dusterhoft et al. | 166/236 |
| 2010/0051270 | A1 * | 3/2010 | Dusterhoft et al. | 166/278 |
| 2011/0024111 | A1 * | 2/2011 | Moen et al. | 166/278 |
| 2011/0056677 | A1 * | 3/2011 | Holderman | 166/205 |
| 2011/0247833 | A1 * | 10/2011 | Todd et al. | 166/386 |
| 2012/0067574 | A1 * | 3/2012 | Lopez | 166/278 |
| 2012/0118583 | A1 * | 5/2012 | Johnson et al. | 166/376 |
| 2012/0227823 | A1 | 9/2012 | Veit | |
| 2013/0062072 | A1 * | 3/2013 | Alvarez et al. | 166/376 |
| 2014/0020898 | A1 * | 1/2014 | Holderman et al. | 166/304 |

OTHER PUBLICATIONS

Schlumberger Oilfield Glossary Entry for "inflow control device", accessed Sep. 22, 2014 via www.glossary.oilfield.slb.com.*

ISWRO, PCT/US2013/036042, KIPO, Jan. 9, 2014.

* cited by examiner

FLOW CONTROL SCREEN ASSEMBLY HAVING AN ADJUSTABLE INFLOW CONTROL DEVICE

CROSS-REFERENCE TO RELATED APPLICATIONS

This application claims the benefit under 35 U.S.C. §119 of the filing date of International Application No. PCT/US2013/036042, filed Apr. 10, 2013.

TECHNICAL FIELD OF THE INVENTION

This invention relates, in general, to equipment utilized in conjunction with operations performed in subterranean wells and, in particular, to a flow control screen assembly having an inflow control device operable to adjustably control the inflow of formation fluids over the life of the well.

BACKGROUND OF THE INVENTION

Without limiting the scope of the present invention, its background will be described with reference to fluid production from a hydrocarbon bearing subterranean formation, as an example. During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screens positioned proximate the desired production intervals. In other completions, to control the flow rate of production fluids into the production tubing, it is common practice to install one or more flow control devices within the tubing string.

Attempts have been made to utilize fluid flow control devices within completions requiring sand control. For example, in certain sand control screens, after production fluids flows through the filter medium, the fluids are directed into a flow control section. The flow control section may include one or more flow restrictors such as flow tubes, nozzles, labyrinths or the like. Typically, the production rate through these flow control screens is fixed prior to installation by adjusting flow restrictors in the flow control section.

It has been found, however, that due to changes in formation pressure and changes in formation fluid composition over the life of the well, it may be desirable to adjust the flow control characteristics of the flow control screens. In addition, for certain completions, such as long horizontal completions having numerous production intervals or zones, it may be desirable to independently control the inflow of production fluids into each of the production intervals.

Accordingly, a need has arisen for a flow control screen that is operable to control the inflow of formation fluids in a completion requiring sand control. A need has also arisen for such a flow control screen that is operable to adjustably control the inflow of formation fluids as the fluid characteristics of production change over time. Further, a need has arisen for such flow control screens that are operable to independently control the inflow of production fluids from multiple production intervals as the composition of the fluids produced into specific intervals changes over time.

SUMMARY OF THE INVENTION

The present invention disclosed herein comprises a flow control screen for controlling the inflow of formation fluids in completions requiring sand control. In addition, the flow control screen of the present invention is operable to adjustably control the inflow of formation fluids as the fluid characteristics of production change over time. Further, the flow control screens of the present invention are operable to independently control the inflow of production fluids from multiple production intervals as the composition of the fluids produced into specific intervals changes over time.

In one aspect, the present invention is directed to a well system having a fluid flow path for the inflow of production fluid. The well system includes an inflow control device disposed within the fluid flow path. The inflow control device has at least first and second fluid passageways. A first plug is disposed within the first fluid passageway and is operable to restrict fluid flow therethrough. The first plug is operably removable from the first fluid passageway responsive to a first stimulus. A second plug is disposed within the second fluid passageway and is operable to restrict fluid flow therethrough. The second plug is operably removable from the second fluid passageway responsive to a second stimulus, wherein the first stimulus is different from the second stimulus.

In one embodiment, the first plug may be a first material and the second plug may be a second material, wherein the first material is different from the second material. In another embodiment, the first plug may be formed from a first material and the second plug may be formed from the first material and a second material operable to protect the first material from the first stimulus when the second plug is disposed within the second fluid passageway. In certain embodiments, the first stimulus and the second stimulus may each be one or more fluid treatments selected from the group consisting of acids, carboxylic acids, sulfonic acids, organic acids, sulfuric acids, hydrochloric acids, nitric acids, inorganic acids, ammonium, Lewis acids, bases, hydroxides, potassium hydroxide, sodium hydroxide, strong bases, acetone, Lewis bases, gasolines, hydrocarbons, alcohols, water, and chlorides.

In one embodiment, the first plug may be a plug member having a first length and the second plug may be a plug member having a second length, wherein the first length is less than the second length. In this embodiment, the first stimulus may be a fluid treatment of a first duration and the second stimulus may be the fluid treatment of the first duration and a second fluid treatment. In some embodiments, removing the first plug reduces the flow resistance through the inflow control device and removing the second plug further reduces the flow resistance through the inflow control device.

In another aspect, the present invention is directed to a well system having a first fluid flow path associated with a first zone and a second fluid flow path associated with a second zone. The well system includes a first flow control device disposed within the first fluid flow path. The first flow control device has a first fluid passageway with a first plug disposed therein that is operable to restrict fluid flow therethrough. The first plug is operably removable from the first fluid passageway responsive to a first stimulus. A second flow control device is disposed within the second fluid flow path. The second flow control device has a second fluid passageway with a second plug disposed therein that is operable to restrict fluid flow therethrough. The second plug is operably removable from the second fluid passageway responsive to a second stimulus, wherein the first stimulus is different from the second stimulus.

In another aspect, the present invention is directed to a flow control screen assembly having a fluid flow path between a filter medium and an interior of a base pipe. The flow control screen includes an inflow control device disposed within the fluid flow path. The inflow control device has at least first and second fluid passageways. A first plug is disposed within the first fluid passageway and is operable to restrict fluid flow therethrough. The first plug has a shaft formed from a first material, such as a metal, that is operably removable from the first fluid passageway responsive to a first stimulus. A second plug is disposed within the second fluid passageway and is operable to restrict fluid flow therethrough. The second plug has a shaft partially formed from the first material and partially formed from a second material, such as a paint, operable to protect the first material from the first stimulus when the second plug is disposed within the second fluid passageway. The second material is operably removable from the second fluid passageway responsive to a second stimulus, wherein the first stimulus is different from the second stimulus.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
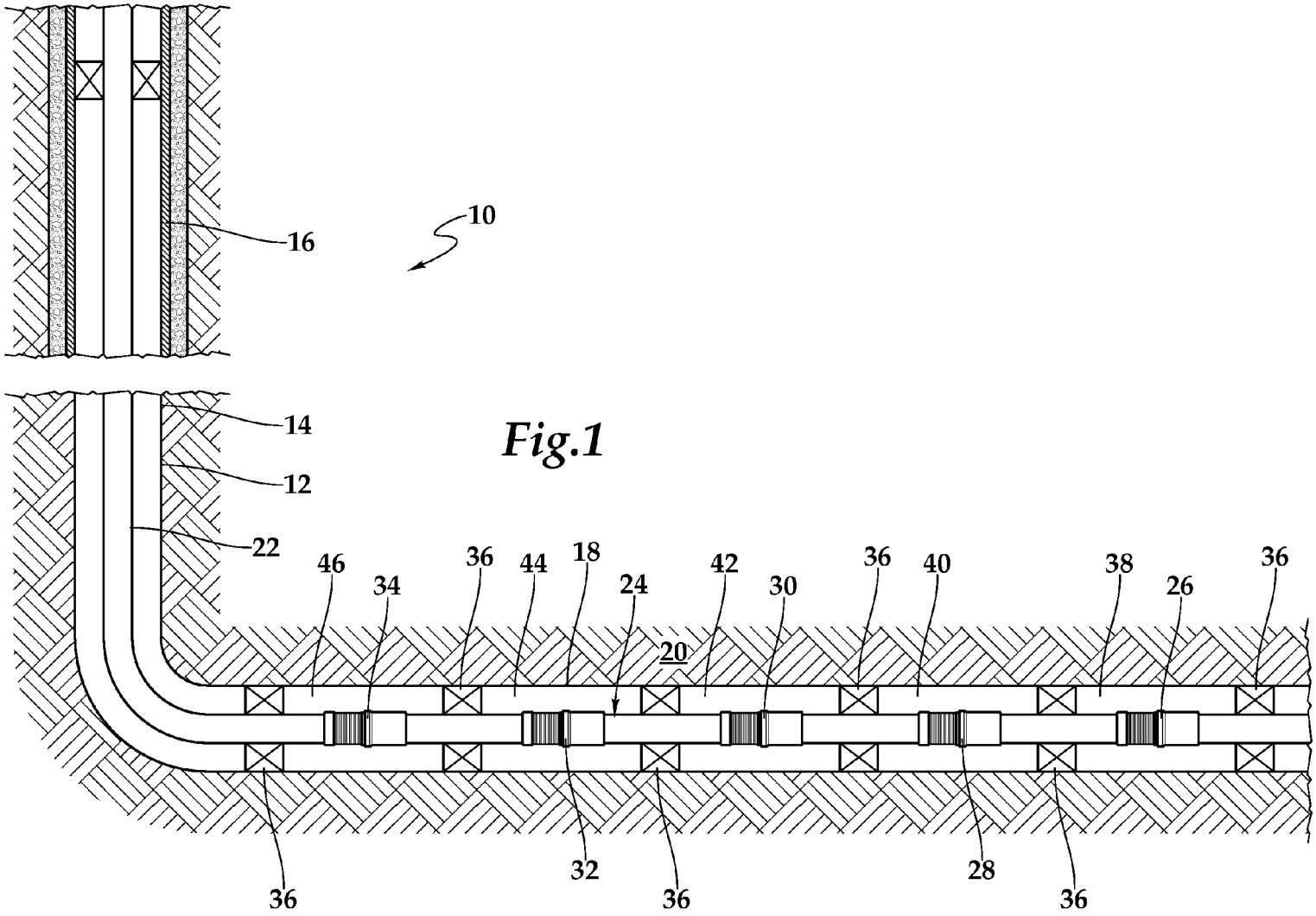
FIG. 1 is a schematic illustration of a well system operating a plurality of flow control screens according to an embodiment of the present invention.

Referring initially to FIG. 1, therein is depicted a well system including a plurality of flow control screens embodying principles of the present invention that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and injection fluids to travel from the surface to formation 20. At its lower end, tubing string 22 is coupled to a completion string 24 that has been installed in wellbore 12 and divides the completion interval into various production intervals or zones adjacent to formation 20. Completion string 24 includes a plurality of flow control screens 26, 28, 30, 32, 34 each of which is positioned between a pair of packers 36 that provides a fluid seal between completion string 24 and wellbore 12, thereby defining production intervals 38, 40, 42, 44, 46. Flow control screens 26, 28, 30, 32, 34 serve the functions of filtering particulate matter out of the production fluid stream and controlling the flow rate of the production fluid stream. In addition, flow control screen 26, 28, 30, 32, 34 are operable to adjustably control the inflow of formation fluids as the fluid characteristics of production change over time. Further, flow control screen 26, 28, 30, 32, 34 are operable to independently control the inflow of production fluids in the various zones as the composition of the fluids produced into the specific intervals changes over time.

Even though FIG. 1 depicts the flow control screens of the present invention in an open hole environment, it should be understood by those skilled in the art that the flow control screens of the present invention are equally well suited for use in cased wells. Also, even though FIG. 1 depicts one flow control screen in each production interval, it should be understood by those skilled in the art that any number of flow control screens of the present invention may be deployed within a production interval without departing from the principles of the present invention.

In addition, even though FIG. 1 depicts the flow control screens of the present invention in a horizontal section of the wellbore, it should be understood by those skilled in the art that the flow control screens of the present invention are equally well suited for use in well having other directional configurations including vertical wells, deviated well, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2A:
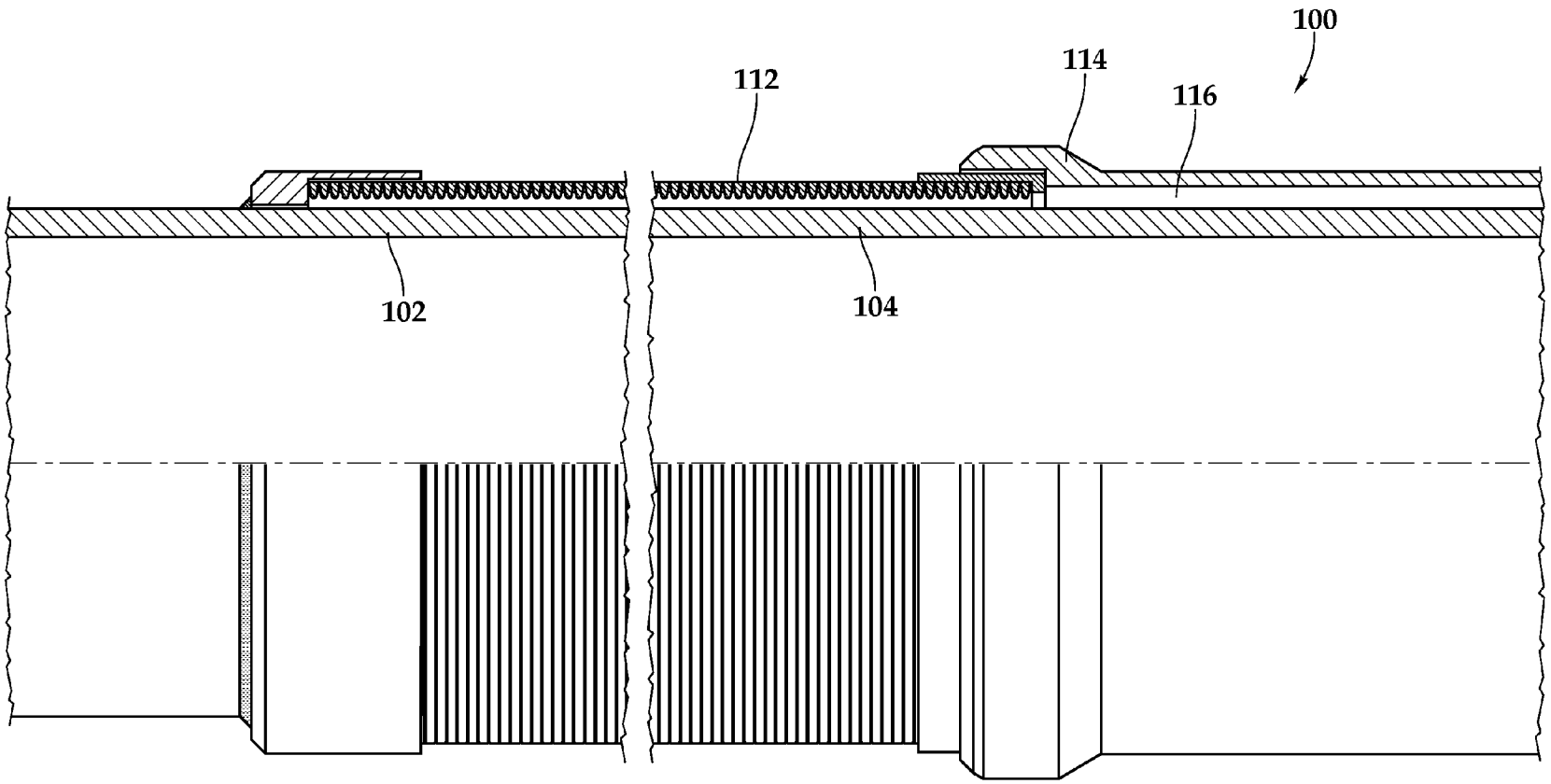
FIGS. 2A-2C are quarter sectional views of successive axial sections of a flow control screen according to an embodiment of the present invention.
Figure 2B:
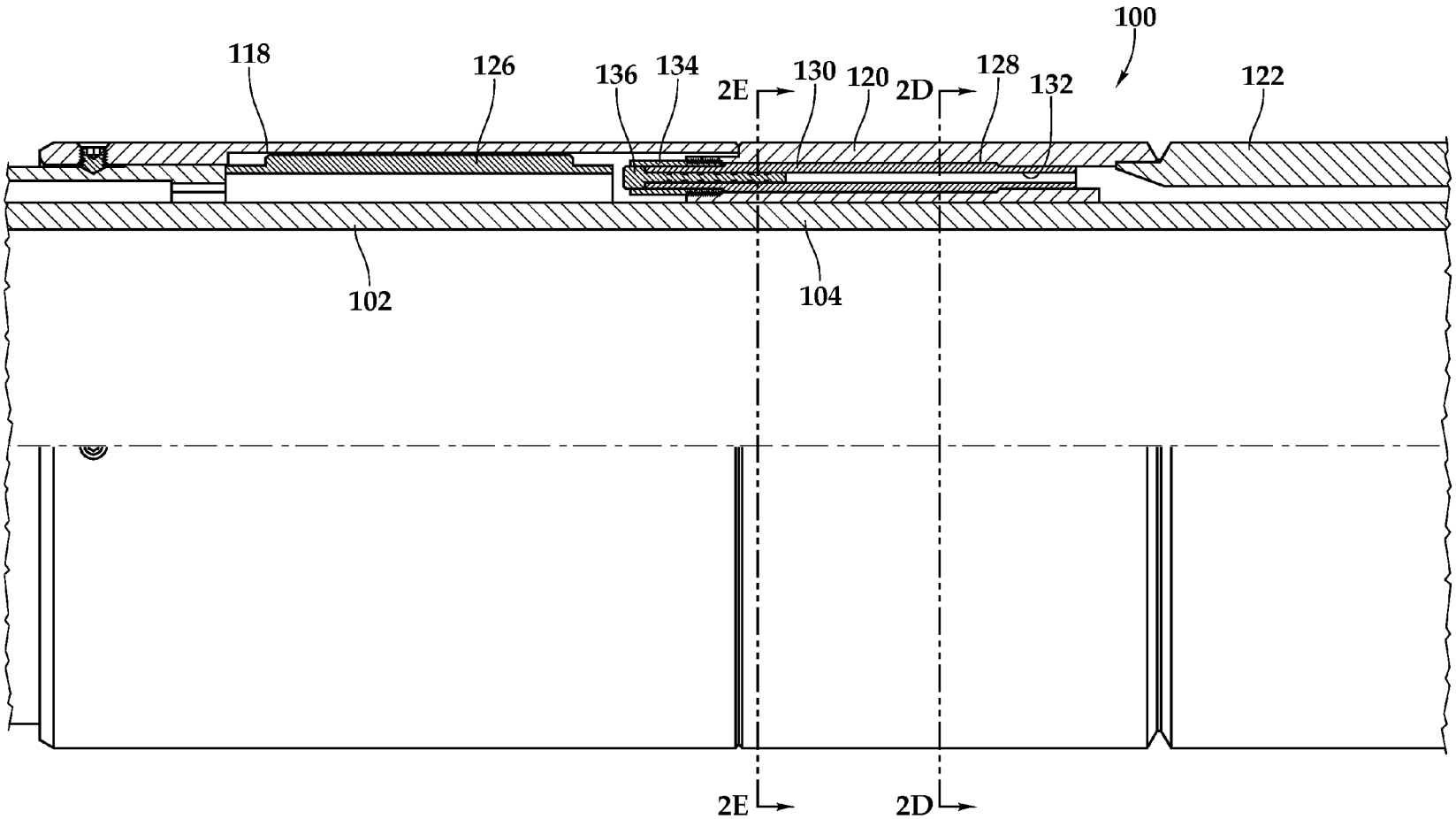
Figure 2C:
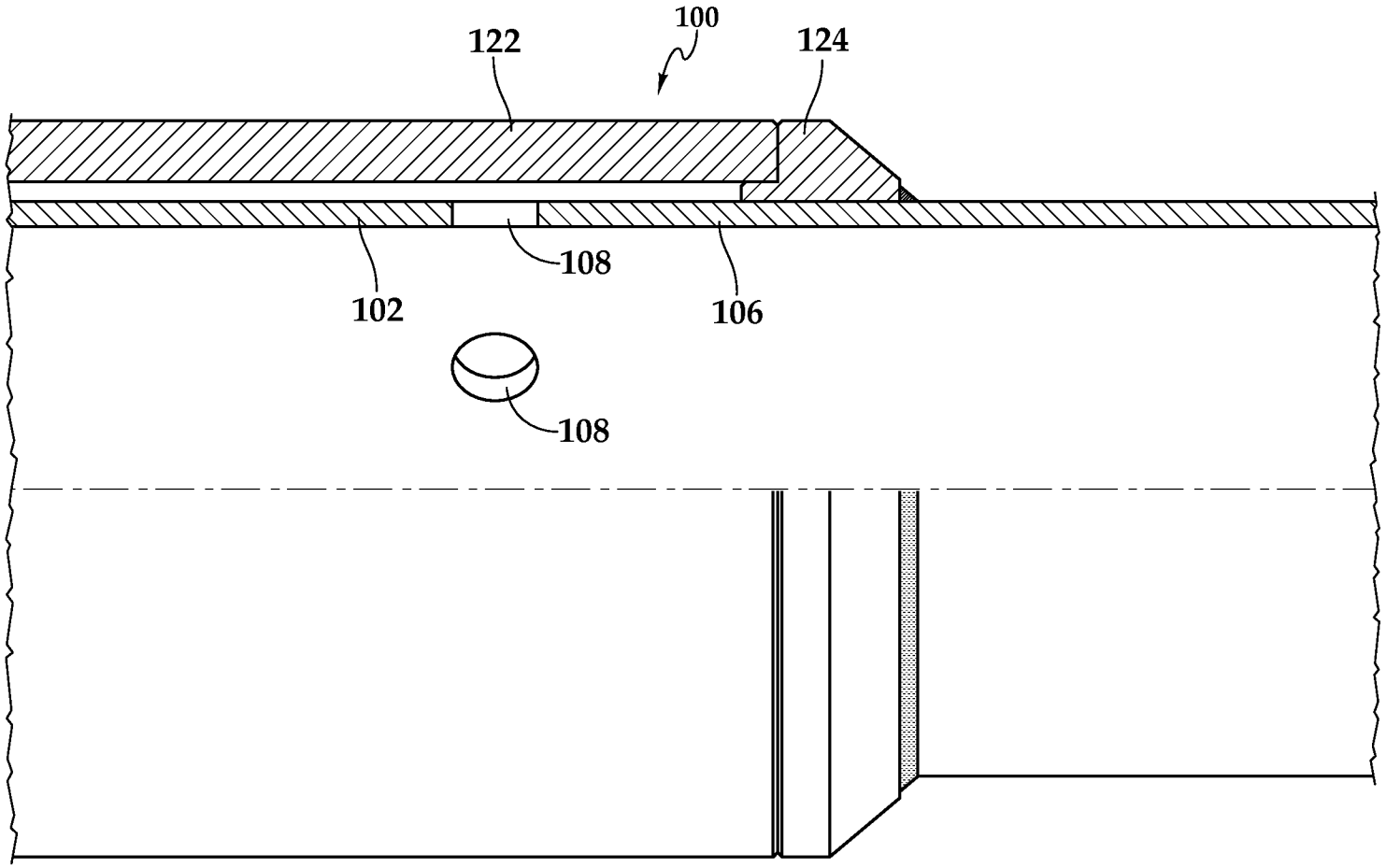

Referring next to FIGS. 2A-2C, therein is depicted successive axial sections of a flow control screen according to the present invention that is representatively illustrated and generally designated 100. Flow control screen 100 may be suitably coupled to other similar flow control screens, production packers, locating nipples, production tubulars or other downhole tools to form a completion string as described above. Flow control screen 100 includes a base pipe 102 that has a blank pipe section 104 and a perforated section 106 including a plurality of production ports 108. Positioned around an uphole portion of blank pipe section 104 is a screen element or filter medium 112, such as a wire wrap screen, a woven wire mesh screen, a prepacked screen or the like, designed to allow fluids to flow therethrough but prevent particulate matter of a predetermined size from flowing therethrough. Positioned downhole of filter medium 112 is a screen interface housing 114 that forms an annulus 116 with base pipe 102. Securably connected to the downhole end of screen interface housing 114 is a sleeve housing 118. At its downhole end, sleeve housing 118 is securably connected to a flow tube housing 120. At its downhole end, flow tube housing 120 is securably connected to a lower housing 122, which is securably connected to end cap 124. End cap 124 is preferably welded to base pipe 102 at its downhole end. The various connections of the housing sections may be made in any suitable fashion including welding, threading and the like as well as through the use of fasteners such as pins, set screws and the like. In addition, flow tube housing 120 is preferably securably connected or sealably coupled to base pipe 102 to prevent fluid flow therebetween. Together, the housing sections create a generally annular fluid flow path between filter medium 112 and perforated section 106 of base pipe 102.

Figure 2D:
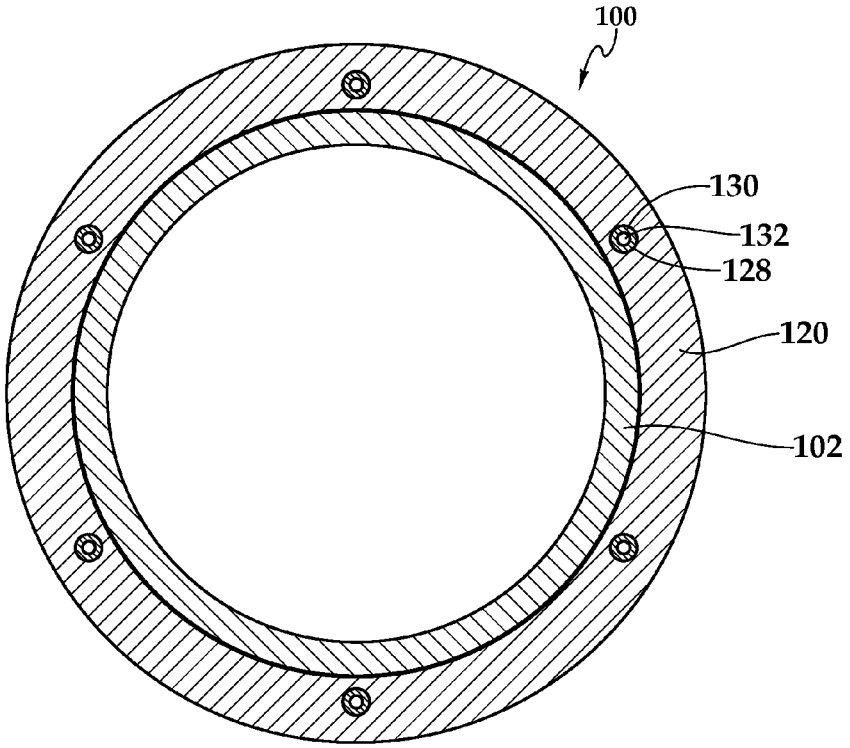
FIG. 2D is a cross sectional view of the flow control screen of FIG. 2B taken along line 2D-2D.
Figure 2E:
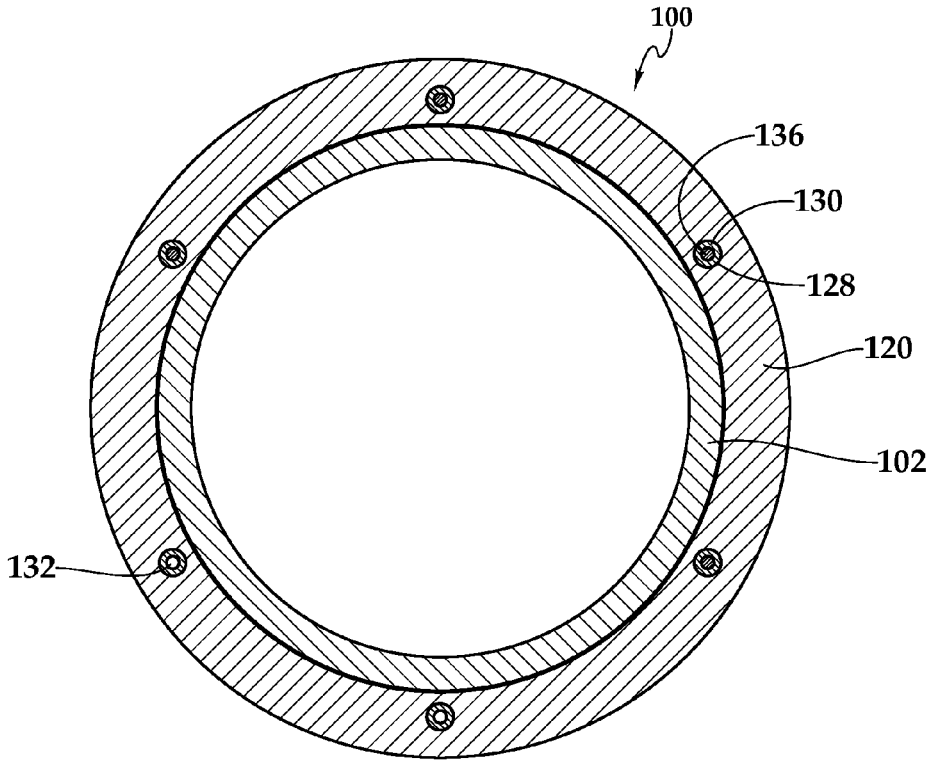
FIG. 2E is a cross sectional view of the flow control screen of FIG. 2B taken along line 2E-2E.

Positioned in the annular region between housing sleeve 118 and base pipe 102 is a split ring spacer 126. As best seen in FIG. 2D, flow tube housing 120 includes six axially extending openings 128. Positioned within each of the axially extending openings 128 is a flow tube 130 having a fluid passageway 132 axially extending therethrough. Flow tubes 130 form a fluid flow control section of flow control screen 100. Even though six flow tubes 130 are depicted in FIG. 2D, those skilled in the art will recognize that other numbers of flow tubes both greater than and less than six could alternatively be used and would be considered within the scope of the present invention. As best seen in FIG. 2B, each of the flow tubes 130 is secured within flow tube housing 120 by a threaded retaining sleeve 134. Flow tubes 130 may have various inner lengths and diameters to allow an operator to establish the level of flow restriction through each flow control screen 100 to a desired level prior to installation such that a completion string including a plurality of flow control screens 100 is operable to counteract heel-toe effects in long horizontal completions, balance inflow in highly deviated and fractured wells, reduce annular sand transportation and reduce water/gas influx, thereby lengthening the productive life of the well. As best seen in FIGS. 2B and 2E, four of the flow tubes 130 have a plug 136 sealably disposed therein to restrict or prevent fluid flow therethrough. Plugs 136 further allow an operator establish the level of flow restriction through each flow control screen 100 to a desired level prior to installation.

As the fluid characteristics of production change over time, each flow control screen 100 is operable to adjustably control the inflow of formation fluids. This is achieved by opening additional fluid passageways 132 through flow tubes 130 by selectively removing plugs 136. As described in greater detail below, certain of the plugs 136 in a given flow control screen 100 or group of flow control screens may have different characteristics such that different stimuli are required to remove all of the plugs 136. For example, the various stimuli may include one or more fluid treatments selected from the group consisting of acids, carboxylic acids, sulfonic acids, organic acids, sulfuric acids, hydrochloric acids, nitric acids, inorganic acids, ammonium, Lewis acids, bases, hydroxides, potassium hydroxide, sodium hydroxide, strong bases, acetone, Lewis bases, gasolines, hydrocarbons, alcohols, water, and chlorides. Other stimuli may include the erosive action of water jetting or other high-pressure fluid treatments.

Figure 3A:
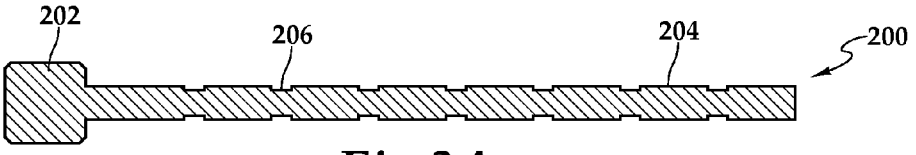
FIGS. 3A-3H are cross sectional views of various plug members for use in a flow control screen according to an embodiment of the present invention.

Referring next to FIG. 3A, therein is depicted a plug member of the present invention that is generally designated 200. Plug member 200 has a head 202, a shaft 204 and a plurality of seal grooves 206 that are operable to receive seals, such as O-ring seals, therein to provide sealing relationships with fluid passageways 132 when plug 200 is installed in a flow tube 130. Plug member 200 is depicted as being formed from a single material, such as a metal including aluminum, magnesium, zinc, iron, alloys of these metals and the like. Once installed in a flow tube 130, plug 200 may be removable responsive to a stimulus such as an acid fluid treatment that would dissolve the metal of plug 200. The acid fluid treatment could be delivered by pumping the treatment fluid downhole from the surface to provide treatment to all zones or via a localized treatment such as using coiled tubing or wireline conveyed tools and straddle packers to provide treatment to a single zone. In either case, the treatment fluid enters production ports 108 of a flow control screen 100 and attacks the lower surface of plugs 200 disposed within flow tubes 130. The metal plugs 200 dissolve responsive to the acid treatment, thereby opening additional fluid passageways 132 through flow tubes 130.

Figure 3B:
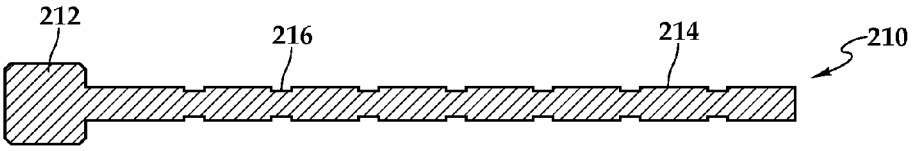

Referring next to FIG. 3B, therein is depicted a plug member of the present invention that is generally designated 210. Plug member 210 has a head 212, a shaft 214 and a plurality of seal grooves 216 that are operable to receive seals, such as O-ring seals, therein to provide sealing relationships with fluid passageways 132 when plug 210 is installed in a flow tube 130. Plug member 210 is depicted as being formed from a single material that is different from the material of plug member 200, such as a plastic. Once installed in a flow tube 130, plugs 210 may be removable responsive to a stimulus such as a gasoline fluid treatment that would dissolve the plastic of plugs 210. The gasoline fluid treatment could be delivered by pumping the treatment fluid downhole from the surface to provide treatment to all zones or via a localized treatment such as using coiled tubing or wireline conveyed tools and straddle packers to provide treatment to a single zone. In either case, the treatment fluid enters production ports 108 of a flow control screen 100 and attacks the lower surface of plugs 210 disposed within flow tube 130. The plastic plugs 210 dissolve responsive to the gasoline treatment, thereby opening additional fluid passageways 132 through flow tubes 130.

In the present invention, certain of the plugs installed in flow tubes 130 of a flow control screen 100 are operably removable from fluid passageways 132 responsive to a first stimulus and others of the plugs installed in flow tubes 130 of a flow control screen 100 are operably removable from fluid passageways 132 responsive to a second stimulus. For example, in the case of a flow control screen 100 having six flow tubes 130 with two of the flow tubes 130 unplugged upon installation and four of the flow tubes 130 plugged upon installation, two of the flow tubes 130 may be plugged with metal plugs 200 and two of the flow tubes 130 may be plugged with plastic plugs 210. In this configuration, a gasoline fluid treatment will dissolve plastic plugs 210 but will not dissolve metal plugs 200. Likewise, an acid fluid treatment will dissolve metal plugs 200 but will not dissolve plastic plugs 210. As such, when it is desired to open two additional fluid passageways 132 through flow tubes 130, a first fluid treatment may be preformed that attacks certain of the plugs but does not attack others of the plugs. Later, when it is desired to open the remaining two fluid passageways 132 through flow tubes 130, a second fluid treatment may be preformed that attacks the remaining plugs that were able to withstand the first fluid treatment. For example, an acid may be used as the first fluid treatment or first stimulus to dissolve the metal plugs but not the plastic plugs and a gasoline may be used as the second fluid treatment or second stimulus to dissolve the plastic plugs. Alternatively, a gasoline may be used as the first fluid treatment or first stimulus to dissolve the plastic plugs but not the metal plugs and an acid may be used as the second fluid treatment or second stimulus to dissolve the metal plugs.

In either case, only two of the plugs within the flow control screen 100 are removed with the first stimulus, thereby opening two of the fluid passageways 132 and reducing the flow resistance through flow control screen 100. The second stimulus opens the additional two fluid passageways 132 through flow control screen 100, thereby further reducing the flow resistance through flow control screen 100. It should be understood by those skilled in the art that even though the present example has described the use of plugs formed from two different materials that require two different stimuli to remove the plugs from fluid passageways 132, the various plugs may be formed from a greater number of different materials requiring a greater number of different stimuli to remove the plugs from fluid passageways 132, thereby adding even greater control over the flow resistance through a flow control screen 100.

Figure 3C:
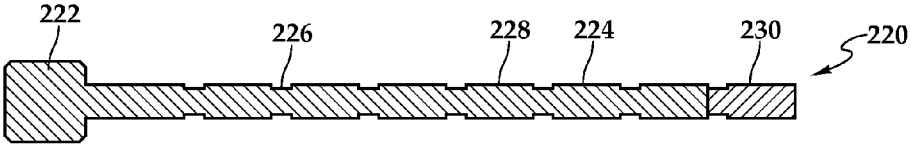

Instead of having plugs that are made from entirely different materials, the same result of requiring different stimuli to remove different plugs can be achieved by forming one or more of the plugs from more than one material. Referring next to FIG. 3C, therein is depicted a plug member of the present invention that is generally designated 220. Plug member 220 has a head 222, a shaft 224 and a plurality of seal grooves 226 that are operable to receive seals, such as O-ring seals, therein to provide sealing relationships with fluid passageways 132 when plug 220 is installed in a flow tube 130. Plug member 220 is depicted as being formed from two materials that are different from one another. For example, the upper portion 228 of shaft 224 may be formed from a metal while the lower portion 230 of shaft 224 may be formed from a plastic. Once installed in a flow tube 130, the plastic lower portion 230 is removable responsive to a gasoline fluid treatment while the metal upper portion 228 is removable responsive to an acid fluid treatment. In this embodiment, if an acid treatment is preformed while plug 220 is intact, the plastic lower portion 230 as well as an optional seal protects the metal upper portion 228 from the acid attack.

In the example of a flow control screen 100 having six flow tubes 130 with two of the flow tubes 130 unplugged upon installation and four of the flow tubes 130 plugged upon installation, two of the flow tubes 130 may be plugged with metal plugs 200 and two of the flow tubes 130 may be plugged with metal/plastic plugs 220. In this configuration, an acid treatment will dissolve the two metal plugs 200 but will not dissolve metal/plastic plugs 220, thereby reducing the flow resistance through flow control screen 100. A subsequent gasoline fluid treatment will dissolve the plastic lower portion 230 of shaft 224, which exposes the lower end of the metal upper portion 228 of shaft 224. In this configuration, a subsequent acid treatment will dissolve the metal upper portion 228 of shaft 224, thereby further reducing the flow resistance through flow control screen 100. As such, the first stimulus required to remove the metal plugs 200 is an acid treatment and the second stimulus required to remove the metal/plastic plugs 220 is a gasoline treatment followed by an acid treatment.

Figure 3D:
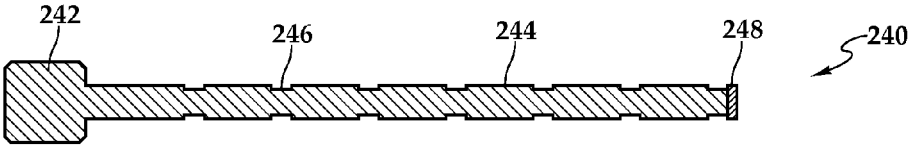

Instead of having a plug formed from two different materials, the same result of requiring different stimuli to remove different plugs can be achieved by placing a coating, foil, film or other protective layer over the end of a plug to protect the reminder of the plug from certain stimuli. Referring next to FIG. 3D, therein is depicted a plug member of the present invention that is generally designated 240. Plug member 240 has a head 242, a shaft 244 and a plurality of seal grooves 246 that are operable to receive seals, such as O-ring seals, therein to provide sealing relationships with fluid passageways 132 when plug 240 is installed in a flow tube 130. In the illustrated embodiment, shaft 244 is formed from single material such as a metal having a protective layer 248 on its lower end. The protective layer 248 is formed from a material that will not react to the same stimulus that is operable to dissolve the metal of shaft 244. In certain embodiments, protective layer 248 may be a paint or other sealant, a wax, a petroleum jelly, a sugar, a salt, a plastic layer or the like. Once installed in a flow tube 130, protective layer 248 may be removable responsive to a stimulus such as a water fluid treatment in the case of a salt, a sugar or a plastic layer 248 such as PGA or PLA plastics, an alcohol fluid treatment in the case of a paint protective layer 248 or other fluid treatment suitable for removing the protective layer 248 that is being used. In this embodiment, if an acid treatment is preformed while plug 240 is intact, a paint protective layer 248, for example, as well as an optional seal protect the metal shaft 244 of plug 240 from the acid attack.

In the example of a flow control screen 100 having six flow tubes 130 with two of the flow tubes 130 unplugged upon installation and four of the flow tubes 130 plugged upon installation, two of the flow tubes 130 may be plugged with metal plugs 200 and two of the flow tubes 130 may be plugged with metal plugs 240 each with a paint protective layer 248. In this configuration, an acid treatment will dissolve metal plugs 200 but will not dissolve metal plugs 240 with paint protective layers 248, thereby reducing the flow resistance through flow control screen 100. Performing an alcohol fluid treatment dissolves the paint protective layers 248 exposing the lower end of metal shaft 244. In this configuration, a subsequent acid treatment will dissolve metal shaft 244 of plug 240, thereby further reducing the flow resistance through flow control screen 100. As such, the first stimulus required to remove the metal plugs 200 is an acid treatment and the second stimulus required to remove paint protective layers 248 then dissolve metal shaft 244 is an alcohol fluid treatment followed by an acid treatment.

As another example, in the case of a flow control screen 100 having six flow tubes 130 with two of the flow tubes 130 unplugged upon installation and four of the flow tubes 130 plugged upon installation, two of the flow tubes 130 may be plugged with metal plugs 240 with a first type of protective layer 248 and two of the flow tubes 130 may be plugged with metal plugs 240 with a second type of protective layer 248. In this configuration, the first stimulus would be a fluid treatment designed to dissolve the first type of protective layer 248 but not dissolve second type of protective layer 248 followed by an acid treatment, thereby reducing the flow resistance through flow control screen 100. Thereafter, the second stimulus would be a fluid treatment designed to dissolve the second type of protective layer 248 followed by an acid treatment, thereby further reducing the flow resistance through flow control screen 100. It should be understood by those skilled in the art that even though the present example has described the use of two different types of protective layers 248 that require two different stimuli for removal, the various plugs may be formed with a greater number of different types of protective layers 248 requiring a greater number of different stimuli for removal, thereby adding even greater control over the flow resistance through a flow control screen 100.

Figure 3E:
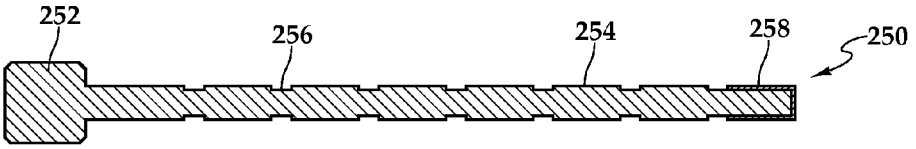

Referring next to FIG. 3E, therein is depicted a plug member of the present invention that is generally designated 250. Plug member 250 has a head 252, a shaft 254 and a plurality of seal grooves 256 that are operable to receive seals, such as O-ring seals, therein to provide sealing relationships with fluid passageways 132 when plug 250 is installed in a flow tube 130. In the illustrated embodiment, shaft 254 is formed from single material such as a metal having a protective layer 258 forming a cap on its lower end. The protective layer 258 is formed from a material that will not react to the same stimulus that is operable to remove the material of shaft 254. Once installed in a flow tube 130, protective layer 258 is removable responsive to a selected stimulus. In operation, plug member 250 performs in substantially the same manner as plug member 240 discussed above.

Figure 3F:
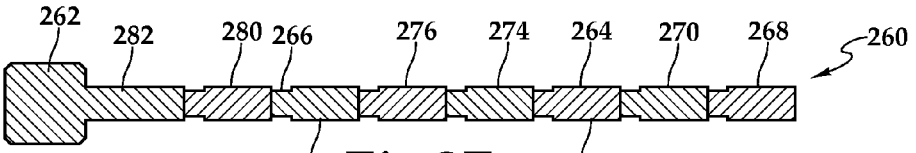

Instead of having a single protective or sacrificial material section, the plug members of the present invention may alternatively have multiple protective or sacrificial material sections. Referring next to FIG. 3F, therein is depicted a plug member of the present invention that is generally designated 260. Plug member 260 has a head 262, a shaft 264 and a plurality of seal grooves 266 that are operable to receive seals, such as O-ring seals, therein to provide sealing relationships with fluid passageways 132 when plug 260 is installed in a flow tube 130. Plug member 260 is depicted as being formed from two materials that are different from one another and that are sequenced relative to one another. For example, shaft 264 may have a plastic section 268, a metal section 270, a plastic section 272, a metal section 274, a plastic section 276, a metal section 278, a plastic section 280 and a metal section 282. In this embodiment, eight treatments are required to remove plug 260 from a fluid passageway 132, for example, a gasoline treatment, an acid treatment, a gasoline treatment, an acid treatment, a gasoline treatment, an acid treatment, a gasoline treatment and an acid treatment as each section of plug 260 protects the next section from fluid attack. It should be understood by those skilled in the art that even though the present example has described an eight section plug member, plug members 260 of the present invention may have any number of sections both greater than and less than eight. As such, plug members 260 enable high versatility in controlling the flow resistance through a flow control screen 100.

In the example of a flow control screen 100 having six flow tubes 130 with two of the flow tubes 130 unplugged upon installation and four of the flow tubes 130 plugged upon installation, the four plugs could be a two section plug, a four section plug, a six section plug and an eight section plug. In this configuration, the first plug can be removed with a two part fluid treatment of gasoline followed by acid. The second plug can removed at later time with an additional two part fluid treatment of gasoline followed by acid. The third plug can removed at another later time with an additional two part fluid treatment of gasoline followed by acid. The fourth plug can removed at a further later time with an additional two part fluid treatment of gasoline followed by acid. It should be understood by those skilled in the art that even though the present example has described the use of two materials sequenced relative to one another, plug members 260 of the present invention may have other numbers of materials sequenced in any number of ways, without departing from the principles of the present invention.

Figure 3G:
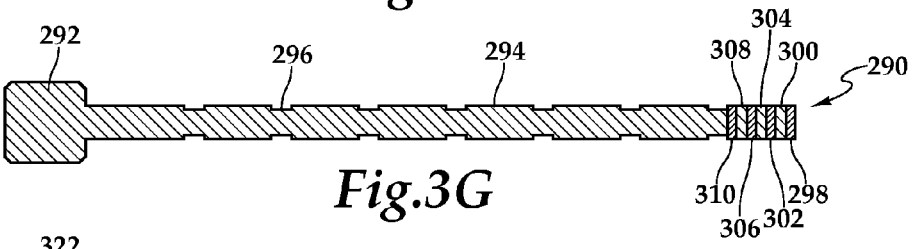

Instead of having a multiple protective or sacrificial material sections, the plug members of the present invention may alternatively have multiple protective or sacrificial coatings, foils, films or other protective layers. Referring next to FIG. 3G, therein is depicted a plug member of the present invention that is generally designated 290. Plug member 290 has a head 292, a shaft 294 and a plurality of seal grooves 296 that are operable to receive seals, such as O-ring seals, therein to provide sealing relationships with fluid passageways 132 when plug 290 is installed in a flow tube 130. Shaft 294 of plug member 290 is depicted as being formed from a single material such as a metal having a plurality of protective layers formed on a lower end thereof. For example, plug member 290 may have a paint layer 298, a metal foil layer 300, a paint layer 302, a metal foil layer 304, a paint layer 306, a metal foil layer 308 and a paint layer 310. In this example, eight treatments are required to remove plug 290 from a fluid passageway 132, for example, an alcohol treatment, an acid treatment, an alcohol treatment, an acid treatment, an alcohol treatment, an acid treatment, an alcohol treatment and an acid treatment as each coating protects the next coating from fluid attack. In operation, plug member 290 performs in substantially the same manner as plug member 260 discussed above.

Figure 3H:
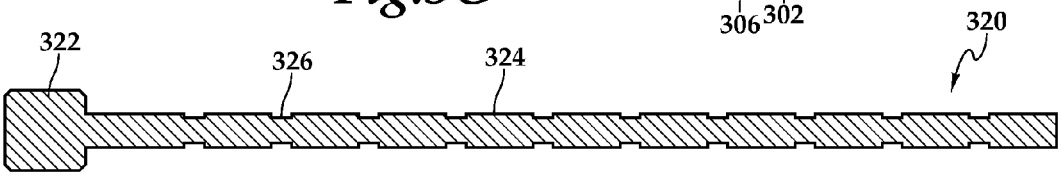

Instead of having a plug formed from different materials, the same result of requiring different stimuli to remove different plugs can be achieved by varying the length of the plugs. Referring next to FIG. 3H, therein is depicted a plug member of the present invention that is generally designated 320. Plug member 320 has a head 322, a shaft 324 and a plurality of seal grooves 326 that are operable to receive seals, such as O-ring seals, therein to provide sealing relationships with fluid passageways 132 when plug 320 is installed in a flow tube 130. In the illustrated embodiment, shaft 324 is depicted as being formed from a single material such as a metal. In addition, shaft 324 is depicted as having eleven sections.

In the example of a flow control screen 100 having six flow tubes 130 with two of the flow tubes 130 unplugged upon installation and four of the flow tubes 130 plugged upon installation, two of the flow tubes 130 may be plugged with metal plugs 200 and two of the flow tubes 130 may be plugged with metal plugs 320. In this configuration, an acid treatment will dissolve metal plugs 200 in a predetermined time period but will not dissolve metal plug 320 in the same time period as more material must be dissolved prior to opening the fluid passageways 132 in which metal plugs 320 reside. Later, when it is desired to open the additional fluid passageways 132, a second fluid treatment may be preformed that attacks the remaining sections of metal plugs 320. To add further versatility, the various plugs disposed within fluid passageways 132 of a flow control screen 100 may each have a different length such that they may be removed one at a time or in another desired sequence.

For completions having multiple zones such as that discussed with reference to FIG. 1, each of the flow control screens 26, 28, 30, 32, 34 may be designed with the same configuration of plugs. For example, each of the flow control screen 26, 28, 30, 32, 34 may have six flow tubes 130 with two of the flow tubes 130 unplugged upon installation and four of the flow tubes 130 plugged upon installation, two of the flow tubes 130 being plugged with a first type of plug and two of the flow tubes 130 being plugged with a second type of plug. In this configuration, the first stimulus would open two additional fluid passageways 132 in each of the flow control screen 26, 28, 30, 32, 34, thereby reducing the flow resistance through each of the flow control screen 26, 28, 30, 32, 34. Thereafter, the second stimulus would open two additional fluid passageways 132 in each of the flow control screen 26, 28, 30, 32, 34, thereby further reducing the flow resistance through each of the flow control screen 26, 28, 30, 32, 34.

Alternatively, for completions having multiple zones such as that discussed with reference to FIG. 1, each of the flow control screens 26, 28, 30, 32, 34 may be designed with a different configuration of plugs. For example, flow control screen 26 may have no plugs, flow control screen 28 may have metal plugs 290 with a single paint layer 310 in all fluid passageways 132, flow control screen 30 may have metal plugs 290 with paint layer 310, foil layer 308 and paint layer 306 in all fluid passageways 132, flow control screen 32 may have metal plugs 290 with paint layer 310, foil layer 308, paint layer 306, foil layer 304 and paint layer 302 in all fluid passageways 132, and flow control screen 34 may have metal plugs 290 with paint layer 310, foil layer 308, paint layer 306, foil layer 304, paint layer 302, foil layer 300 and paint layer 298 in all fluid passageways 132. This configuration may be beneficial in a completion requiring formation fracturing as the fracture fluid treatment can progress uphole by sequentially opening the flow control screens 26, 28, 30, 32, 34 from the toe to the heal of the well.

For example, during the fracture treatment, pads of the appropriate stimuli may be sent downhole to act on the plugs in flow control screens 28, 30, 32, 34. The fracture operation starts in zone 38. When it is desired to move uphole, the first pad is pumped downhole including an alcohol treatment followed by an acid treatment that attacks single paint layers 310 and metal plugs 290 in flow control screen 28, opening all of the fluid passageways 132 therein. The first pad also acts on each of the plugs in flow control screens 30, 32, 34 stripping off the outer paint layers and the outer metal foil layers but not opening the fluid passageways 132 therein. The fracture operation may now commence in zone 40. When it is desired to move uphole, the second pad is pumped downhole including an alcohol treatment followed by an acid treatment that attacks paint layers 310 and metal plugs 290 in flow control screen 30 opening all of the fluid passageways 132 therein. The second pad also acts on each of the plugs in flow control screens 32, 34 stripping off the outer paint layers and outer metal foil layers but not opening the fluid passageways 132 therein. The fracture operation may now commence in zone 42.

When it is desired to move uphole again, the third pad is pumped downhole including an alcohol treatment followed by an acid treatment that attacks paint layers 310 and metal plugs 290 in flow control screen 32 opening all of the fluid passageways 132 therein. The third pad also acts on each of the plugs in flow control screen 34 stripping off the outer paint layers and outer metal foil layers but not opening the fluid passageways 132 therein. The fracture operation may now commence in zone 44. When it is desired to move uphole, the fourth pad is pumped downhole including an alcohol treatment followed by an acid treatment that attacks paint layers 310 and metal plugs 290 in flow control screen 34 opening all of the fluid passageways 132 therein. The fracture operation may now commence in zone 46. In this manner, the present invention enables fluid flow control through a plurality of flow control screens by selectively removing plugs from flow passageways using sequential stimuli.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A well system comprising:

a base pipe with an axially extending internal passageway, a blank pipe section and a perforated section;

a filter medium positioned around the blank pipe section of the base pipe;

a housing positioned around the base pipe defining a fluid flow path between the filter medium and the internal passageway;

an inflow control device disposed within the fluid flow path, the inflow control device having at least first and second axially extending fluid passageways;

a first axially extending plug disposed within the first fluid passageway and operable to restrict fluid flow therethrough, the first plug operably removable from the first fluid passageway responsive to a first fluid treatment; and a second axially extending plug disposed within the second fluid passageway and operable to restrict fluid flow therethrough, the second plug operably removable from the second fluid passageway responsive to a second fluid treatment;

wherein, the first fluid treatment is different from the second fluid treatment;

wherein, the first plug comprises a first material;

wherein the second plug comprises a head, a shaft, and a plurality of seal grooves that are operable to receive seals;

wherein the shaft of the second plug comprises a first portion, a second portion, a third portion, and a fourth portion sequenced relative to each other; and wherein the first portion and the third portion are comprised of the first material and the second portion and the fourth portion are comprised of a second material operable to protect the first material of the second plug from the first fluid treatment when the second plug is disposed within the second fluid passageway.

2. The well system as recited in claim 1 wherein the first fluid treatment is selected from the group consisting of acids, bases, hydrocarbons, alcohols, and water.

3. The well system as recited in claim 1 wherein the second fluid treatment is selected from the group consisting of acids, bases, hydrocarbons, alcohols, and water.

4. The well system as recited in claim 1 wherein the first material is a metal and wherein the second material is a plastic.

5. The well system as recited in claim 1 wherein removing the first plug reduces the flow resistance through the inflow control device and wherein removing the second plug further reduces the flow resistance through the inflow control device.

6. A well system having a first flow control screen associated with a first zone and a second flow control screen associated with a second zone, the well system comprising:

the first flow control screen includes a first base pipe with a first axially extending internal passageway, a first blank pipe section and a first perforated section, a first filter medium positioned around the first blank pipe section of the first base pipe and a first housing positioned around the first base pipe defining a first fluid flow path between the first filter medium and the first internal passageway;

a first flow control device disposed within the first fluid flow path, the first flow control device having a first axially extending fluid passageway with a first axially extending plug disposed therein and operable to restrict fluid flow therethrough, the first plug operably removable from the first fluid passageway responsive to a first fluid treatment;

the second flow control screen includes a second base pipe with a second axially extending internal passageway, a second blank pipe section and a second perforated section, a second filter medium positioned around the second blank pipe section and a second housing positioned around the second base pipe defining a second fluid flow path between the second filter medium and the second internal passageway; and a second flow control device disposed within the second fluid flow path, the second flow control device having a second axially extending fluid passageway with a second axially extending plug disposed therein and operable to restrict fluid flow therethrough, the second plug operably removable from the second fluid passageway responsive to a second fluid treatment;

wherein, the first fluid treatment is different from the second fluid treatment;

wherein the first plug comprises a first material;

wherein the second plug comprises a head, a shaft, and a plurality of seal grooves that are operable to receive seals;

wherein the shaft of the second plug comprises a first portion, a second portion, a third portion, and a fourth portion sequenced relative to each other; and wherein the first portion and the third portion are comprised of the first material and the second portion and the fourth portion are comprised of a second material operable to protect the first material of the second plug from the first fluid treatment when the second plug is disposed within the second fluid passageway.

7. The well system as recited in claim 6 wherein the first fluid treatment is selected from the group consisting of acids, bases, hydrocarbons, alcohols, and water.

8. The well system as recited in claim 6 wherein the second fluid treatment is selected from the group consisting of acids, bases, hydrocarbons, alcohols, and water.

9. The well system as recited in claim 6 wherein the first material is a metal and wherein the second material is a plastic.

10. The well system as recited in claim 6 wherein removing the first plug reduces the flow resistance through the first flow control device and wherein removing the second plug reduces the flow resistance through the second flow control device.

11. A flow control screen assembly having a fluid flow path between a filter medium and an axially extending internal passageway of a base pipe, the flow control screen comprising:

an inflow control device disposed within the fluid flow path, the inflow control device having at least first and second axially extending fluid passageways;

a first axially extending plug disposed within the first fluid passageway and operable to restrict fluid flow therethrough, the first plug having a shaft formed from a first material that is operably removable from the first fluid passageway responsive to a first fluid treatment; and a second axially extending plug disposed within the second fluid passageway and operable to restrict fluid flow therethrough, the second plug having a shaft, a head, and a plurality of seal grooves that are operable to receive seals, the shafting having a first portion, a second portion, a third portion, and a fourth portion sequenced relative to each other, and wherein the first portion and the third portion are formed from the first material and the second portion and the fourth portion are formed from a second material operable to protect the first material from the first fluid treatment when the second plug is disposed within the second fluid passageway, the second material operably removable from the second fluid passageway responsive to a second fluid treatment;

wherein, the first fluid treatment is different from the second fluid treatment.

12. The flow control screen assembly as recited in claim 11 wherein the first fluid treatment and the second fluid treatment are each selected from the group consisting of acids, bases, hydrocarbons, alcohols, and water.

13. The flow control screen assembly as recited in claim 11 wherein removing the first plug reduces the flow resistance through the inflow control device and wherein removing the second plug further reduces the flow resistance through the inflow control device.

14. The flow control screen assembly as recited in claim 11 wherein the first material is a metal and wherein the second material is a plastic.

15. A well system comprising:

a base pipe with an axially extending internal passageway, a blank pipe section and a perforated section;

a filter medium positioned around the blank pipe section of the base pipe;

a housing positioned around the base pipe defining a fluid flow path between the filter medium and the internal passageway;

an inflow control device disposed within the fluid flow path, the inflow control device having at least first and second axially extending fluid passageways;

a first axially extending plug disposed within the first fluid passageway and operable to restrict fluid flow therethrough, the first plug operably removable from the first fluid passageway responsive to a first fluid treatment; and a second axially extending plug disposed within the second fluid passageway and operable to restrict fluid flow therethrough, the second plug operably removable from the second fluid passageway responsive to a second fluid treatment;

wherein, the first fluid treatment is different from the second fluid treatment;

wherein the first plug comprises a plug member having a first axial length and the second plug comprises a plug member having a second axial length, wherein the first axial length is less than the second axial length;

wherein the first plug is formed from a first single material; and wherein the second plug is formed from a second single material that is different from the first single material.

16. The well system as recited in claim 15 wherein the first fluid treatment and the second fluid treatment are each selected from the group consisting of acids, bases, hydrocarbons, alcohols, and water.

17. The well system as recited in claim 15 wherein the first stimulus is a fluid treatment of a first duration and wherein the second stimulus further comprises the fluid treatment of the first duration and a second fluid treatment.

18. The well system as recited in claim 15 wherein removing the first plug reduces the flow resistance through the inflow control device and wherein removing the second plug further reduces the flow resistance through the inflow control device.

19. The well system as recited in claim 15, wherein the first single material is a metal and wherein the second single material is a plastic.

20. A well system having a first flow control screen associated with a first zone and a second flow control screen associated with a second zone, the well system comprising:

the first flow control screen includes a first base pipe with a first axially extending internal passageway, a first blank pipe section and a first perforated section, a first filter medium positioned around the first blank pipe section of the first base pipe and a first housing positioned around the first base pipe defining a first fluid flow path between the first filter medium and the first internal passageway;

a first flow control device disposed within the first fluid flow path, the first flow control device having a first axially extending fluid passageway with a first axially extending plug disposed therein and operable to restrict fluid flow therethrough, the first plug operably removable from the first fluid passageway responsive to a first fluid treatment;

the second flow control screen includes a second base pipe with a second axially extending internal passageway, a second blank pipe section and a second perforated section, a second filter medium positioned around the second blank pipe section and a second housing positioned around the second base pipe defining a second fluid flow path between the second filter medium and the second internal passageway; and a second flow control device disposed within the second fluid flow path, the second flow control device having a second axially extending fluid passageway with a second axially extending plug disposed therein and operable to restrict fluid flow therethrough, the second plug operably removable from the second fluid passageway responsive to a second fluid treatment;

wherein, the first fluid treatment is different from the second fluid treatment;

wherein, the first plug comprises a plug member having a first axial length and the second plug comprises a plug member having a second axial length, wherein the first axial length is less than the second axial length;

wherein the first plug is formed from a first single material; and wherein the second plug is formed from a second single material that is different from the first single material.

21. The well system as recited in claim 20 wherein the first fluid treatment and the second fluid treatment are each selected from the group consisting of acids, bases, hydrocarbons, alcohols, and water.

22. The well system as recited in claim 20 wherein the first stimulus is a fluid treatment of a first duration and wherein the second stimulus further comprises the fluid treatment of the first duration and a second fluid treatment.

23. The well system as recited in claim 20 wherein removing the first plug reduces the flow resistance through the first flow control device and wherein removing the second plug reduces the flow resistance through the second flow control device.

24. The well system as recited in claim 20, wherein the first single material is a metal and wherein the second single material is a plastic.

* * * * *